United States Patent [19]

Blackwell

[11] Patent Number: 4,467,822

[45] Date of Patent: Aug. 28, 1984

[54] TOOTHBRUSH

[76] Inventor: Victor C. Blackwell, 69, Westminster Dr., Bromborough, Wirral, Merseyside, England

[21] Appl. No.: 304,002

[22] Filed: Sep. 21, 1981

[30] Foreign Application Priority Data

Sep. 25, 1980 [GB] United Kingdom ..... 8030886

[51] Int. Cl.[3] ..... A63H 27/00

[52] U.S. Cl. ..... 132/84 B; 132/84 D

[58] Field of Search ..... 132/84 R, 84 B, 84 D, 132/84 A; 401/107, 111, 286–287, 191, 274–275, 281, 171–176, 182; 15/167 R, 167 A, 185, 172, 144 R; 222/537, 191, 533–534, 536, 526–527

[56] References Cited

U.S. PATENT DOCUMENTS

| | | | |
|---|---|---|---|
| 2,509,120 | 5/1950 | Warren | 222/526 |
| 3,613,698 | 10/1971 | Fox | 132/84 D |
| 3,734,118 | 11/1971 | Howard | 132/84 |
| 3,864,047 | 2/1975 | Sherrod | 132/84 R |
| 4,002,181 | 1/1977 | Rivera | 132/84 D |
| 4,130,134 | 12/1978 | Castle | 222/527 |

FOREIGN PATENT DOCUMENTS

| | | | |
|---|---|---|---|
| 603148 | 4/1926 | France | 15/185 |
| 266598 | 4/1950 | Switzerland | 401/281 |
| 400831 | 11/1933 | United Kingdom . | |
| 527622 | 10/1940 | United Kingdom . | |
| 792448 | 3/1958 | United Kingdom . | |
| 969378 | 9/1964 | United Kingdom . | |
| 1244915 | 9/1971 | United Kingdom . | |
| 1336755 | 11/1973 | United Kingdom . | |

*Primary Examiner*—C. Fred Rosenbaum
*Assistant Examiner*—Sherri E. Vinyard
*Attorney, Agent, or Firm*—Steinberg & Raskin

[57] ABSTRACT

A combined toothpaste dispenser and toothbrush device comprising an elongate container for receiving or containing toothpaste and forming a handle member, a toothbrush member connected or connectable to said container and supporting bristles, ducting leading or capable of leading from the container to the bristles of said brush member, and a device for urging toothpaste through the ducting from the container to the bristles, characterized by the feature that the toothbrush member is adapted to be displaced relative to the elongate container so that in an inoperative position the brush member is juxtaposed or lies along the container while in the operative position the brush member extends from the end of the container and away from it to permit teeth-cleaning operations to be effected.

10 Claims, 28 Drawing Figures

TOOTHBRUSH

The present invention relates to an improved combination of toothpaste dispensing device and toothbrush.

In my prior British Patent Application No.7942353 there is disclosed a combined toothpaste dispenser and toothbrush comprising an elongate container for receiving or containing toothpaste and forming a handle member, a toothbrush portion or member connected to said container and extending rigidly therefrom, ducting means leading from the container to the bristles of said brush portion or member, and means for enabling paste to be urged through said ducting means to said bristles.

Various prior specifications have been revealed relating to similar subject matter although none of such prior specifications have advantageous closure means for the paste duct nor can they be readily reduced in length, especially by pivoting, sliding or telescoping of the main components thereof to produce a compact arrangement in the inoperative condition.

It is an object of the invention to overcome disadvantages of prior devices and provide the advantageous feature described herein.

According to the present invention there is provided a combination comprising an improved toothpaste dispenser and toothbrush comprising an elongate container for receiving or containing toothpaste and forming a handle member, a toothbrush member connected or connectable to said container, ducting means leading or capable of leading from the container to the bristles of said brush member, and means for enabling paste to be urged through said ducting means to said bristles; said toothbrush member being adapted to be displaced relative to said elongate container so that in an inoperative position the brush member is juxtaposed or lies along said container whilst in the operative position the brush member extends from the end of said container away therefrom to permit teeth cleaning operations to be effected.

It is generally intended that the mounting of the brush member on the container to permit the brush member to be folded or moved against or into the region of the container when not in use is generally achieved by pivot or hinged interconnection means between the brush member and container—or sliding or telescopic arrangements as will be hereinafter described—although, if desired, the two components may be separable and securable in either of the two mentioned positions of use and non-use. However, the two members will normally be pivoted together by suitable means as will be described hereinafter.

Whilst it is possible for the brush member in its folded or position of non-use, to have toothpaste applied to the bristles from the exterior thereof (e.g. via a duct of the container leading to the region of the bristles as a separate integer and not part of the brush member direct) it is normally intended that the toothpaste be supplied and directed by suitable ducting means within the brush member and leading to the bristle region thereof as will also be described herein.

In one embodiment of the invention it is proposed that a paste duct extending from the container in the form of an angled tubular duct be pivotally connected coaxially with a tubular duct of the paste duct of the brush member to permit desired pivotal connection between the components.

The invention will be described further, by way of example, with reference to the accompanying drawings in which:

FIG. 1 comprises a schematic perspective view of a simple embodiment of the present invention;

Figure 5:
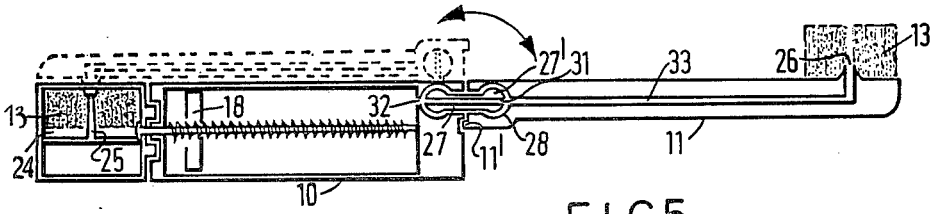
FIG. 5 is a schematic sectional illustration of an alternative embodiment of the invention wherein the components of the device are interconnected by an apertured pivot member.
Figure 5B:
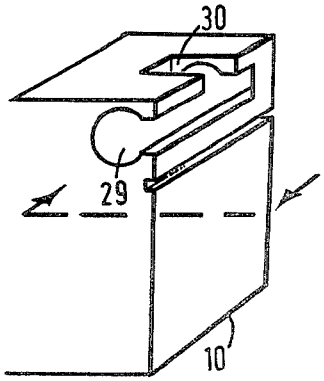
Figure 6:
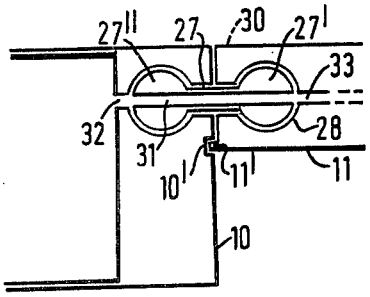
Figure 5A:
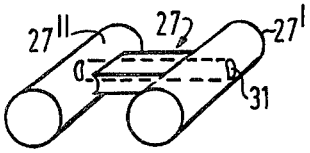
Figure 7:
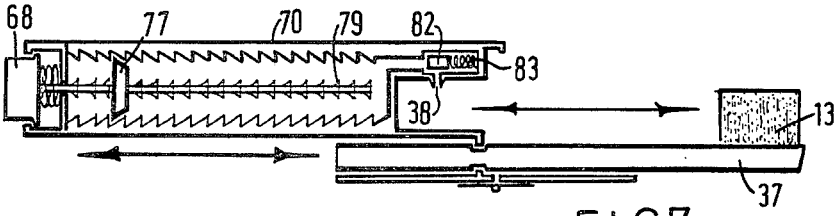
Figure 7A:
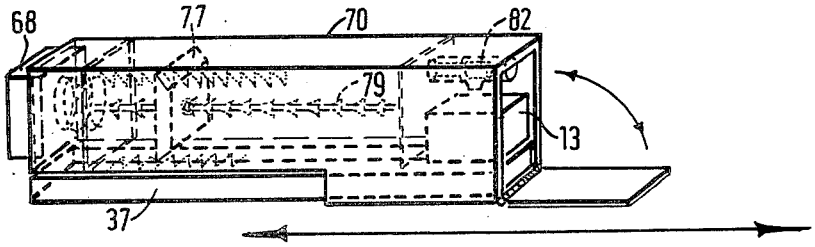
Figure 8:
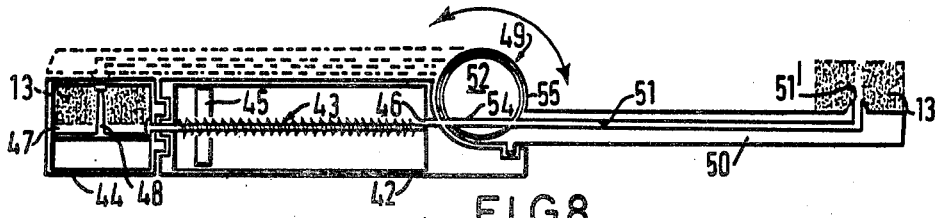
Figure 9:
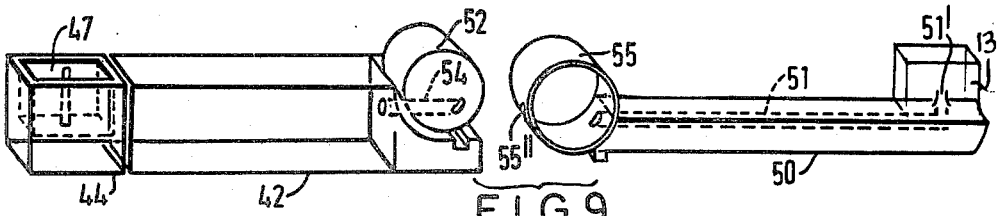
Figure 11:
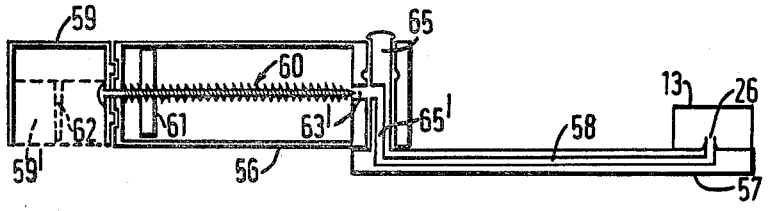
Figure 12:
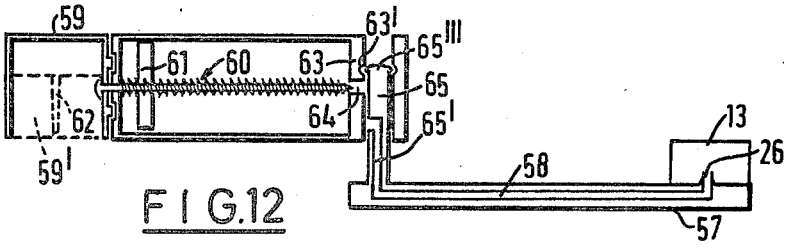
Figure 10:
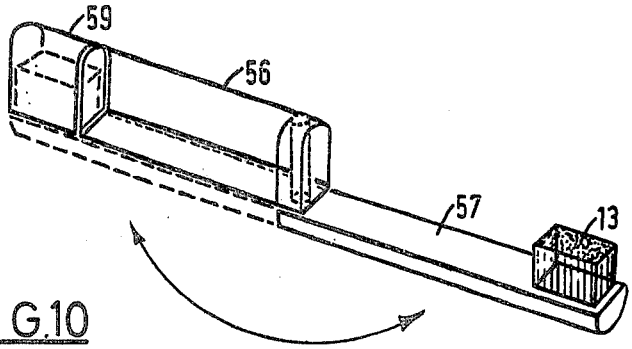
Figure 13:
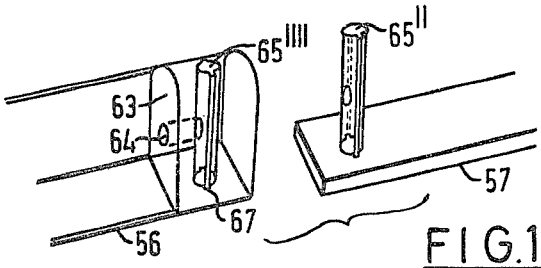
Figure 14:
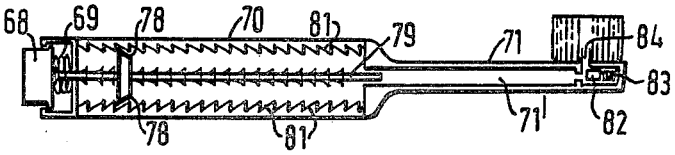
Figure 15:
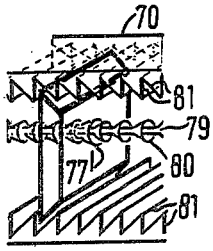
Figure 16:
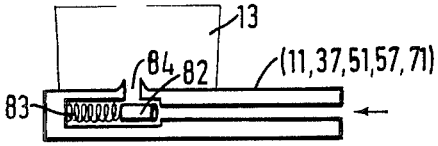
Figure 17:
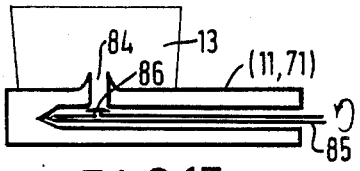
Figure 25:
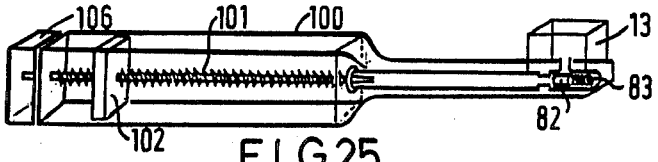
Figure 26:
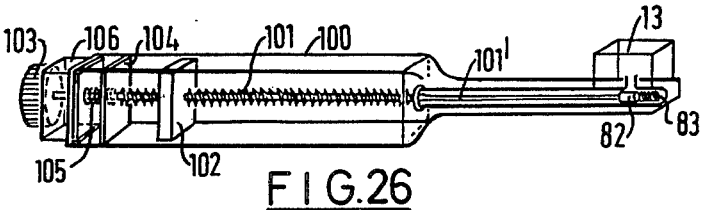
Figure 27:
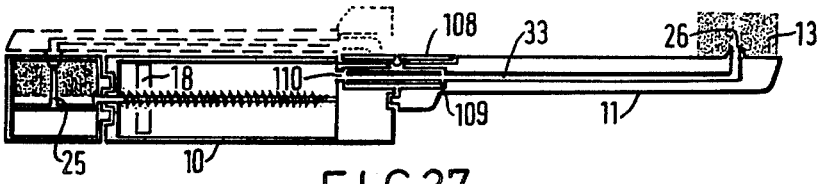
Figure 28:
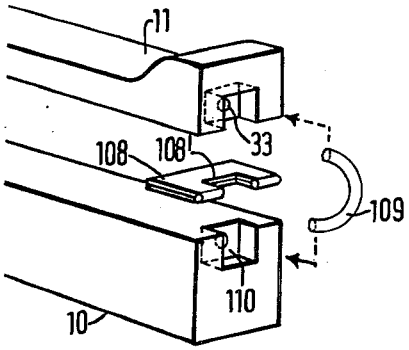

FIGS. 5*a* and 5*b* comprise different fragmentary perspective views of the pivot member and a socket therefor in the dispensing container;

FIG. 6 is a further fragmentary schematic illustration showing the pivot interconnection of FIG. 5;

FIGS. 7 and 7*a* are schematic views of a further embodiment wherein a sliding arrangement is illustrated;

FIG. 8 is a schematic side elevation and part section of an alternative embodiment of a folding toothbrush and toothpaste dispenser;

FIG. 9 is a schemtic perspective view of the device of FIG. 8 wherein the brush member and paste container or handle members are shown separated;

FIG. 10 is a schematic perspective view of a further embodiment of a toothbrush in the folded operative position;

FIG. 11 is a schematic sectional illustration of the toothbrush of FIG. 10;

FIG. 12 is a schematic sectional illustration of the toothbrush of FIG. 11 with the pivot member axially displaced prior to pivoting and movement together into the inoperative position shown in broken line in FIG. 10;

FIG. 13 is a fragmentary view of the pivot members of FIGS. 11 and 12 shown separately;

FIG. 14 is a schematic illustration of a non-folding embodiment having alternative paste displacing means and also an alternative paste duct closure means;

FIG. 15 is an enlarged fragmentary detail of a stepping device of the paste displacing means of FIG. 14;

FIG. 16 is an enlarged fragmentary schematic illustration of the paste duct closure means as used in the toothbrush of FIG. 14;

FIG. 17 is an enlarged fragmentary illustration of an alternative paste duct closure means suitable for use in a previous embodiment as an extension of a rotary, axially displaceable threaded member used for displacing the paste pressure member;

FIGS. 18 to 24 show various alternative arrangements of means forming the paste duct closure means;

FIG. 25 illustrates an embodiment wherein a rotary threaded member is provided for displacing the paste pressurizing means and the paste duct closure means of FIG. 16 is included therein;

FIG. 26 is a schematic illustration of an alternative arrangement of a non-pivoting toothbrush wherein a paste duct closure means is provided on an extension of the threaded member which in addition to being rotatable to displace the paste pressurizing means, is also axially displaceable to displace the paste duct closure means to open and close an outlet leading to the bristles; and FIGS. 27 and 28 are schematic views of a further embodiment where the paste container and brush member are hingedly interconnected and the interconnection of the paste ducts effected by a flexible tubular member.

Figure 1:
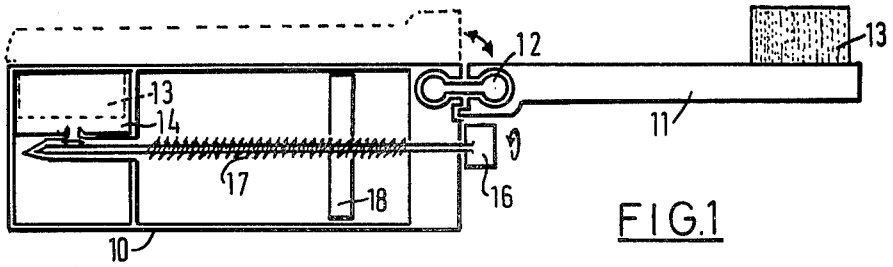

In the embodiment of FIG. 1, a paste container 10 and brush member 11 are interconnected by a hinge member 12. Similar in construction as the member 27 (and surrounding housing) as the corresponding components (27) of FIGS. 5, 5*a*, 5*b* and 6 except that member 12 does not have a paste passage therethrough. The brush member is displaceable out of the secured operative position shown in full lines in FIG. 1 into an inoperative position as shown in broken line with the bristles 13 resting in a recess 14. Paste may be urged onto the bristles 13' via duct 15 in the recess by turning knob 16 of a paste displacing means comprising a screw means 17 rotatable within the container 10 by knob 16. Rotation of screw 17 causes a piston or pressure member 18 to be displaced within container 10 to cause paste contained therein to be urged out of duct 15 onto the bristles 13. Closure of the paste duct in the example given is effected by the means shown in FIG. 17 although any suitable alternative arrangement may be used.

Figure 2:
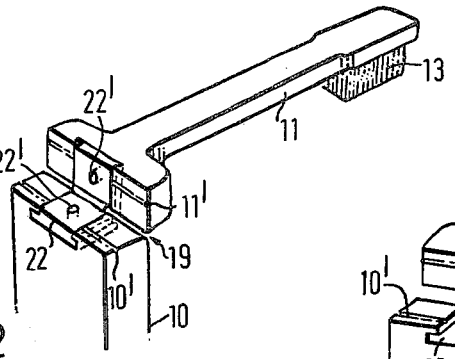
FIG. 2 is a fragmentary schematic perspective illustration of an alternative embodiment.
Figure 3:
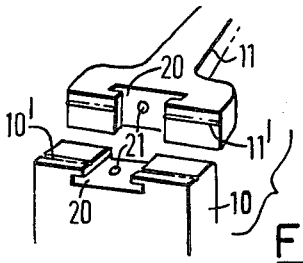
FIG. 3 is a fragmentary detailed perspective view of the device of FIG. 2 but wherein a sliding closure hinge is omitted to show the paste ducts within the container and bristle member.
Figure 4:
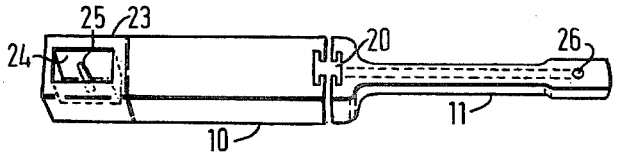
FIG. 4 is a schematic perspective view showing the device in the opened-out operative position but with the closure hinge omitted also.

The device of FIGS. 2, 3 and 4 comprises a toothpaste container 10 and brush member 11 pivotally interconnected at 19 (not shown in detail) with the container 10 and brush member 11 having oppositely facing and similarly shaped, T-shaped recesses 20. The container and brush members are releasably secured in the operative position by any suitable means, such as a groove 10' and projection 11' in the container and brush members respectively and of the type described in connection with the embodiment of FIGS. 5 and 6. Paste ducting means open in apertures 21 in the central T-shaped portion of the cross-piece of recesses 20 and are disposed so that in the open position with the brush member 11 pivoted so as to extend from the end of the container 10 the apertures 21 are aligned and interconnected by an apertured, slidable-hinge-valve member 22 shown in position in FIG. 2. This slidable member 22 includes two wings or plates having apertures 22' therein and which are slidable in the recesses 20 of the container 10 and brush member 11 such that in the position of use (FIG. 4) with the apertures 21 aligned together, the apertures 22' in the wings of the hinge are also aligned with the apertures 21 so as to permit paste to be urged therethrough by means (not shown in detail) which may be similar to those described in FIG. 1 as required and supplied via ducting means to the bristles of the brush member as hereinbefore described. At the end of the container 10 is a rotary member 23 which is rotatable to move the paste displacing means. The rotary member 23 is rectangular and has a recess 24 into which the bristles of the brush may be located in the folded position. A pin 25 is provided in the recess and located in a paste duct aperture 26 which enables paste to be urged onto the bristles 13. This pin 25 stops aperture 26 and prevents discharge and hardening of the paste therein. The hinge closure member 22 will be restricted in its movement so as not to fall out of the recesses 20 and operates such that as the brush member 11 is pivoted into the folded position, the movement of said brush member 11 relative to the container 10 causes the apertures 22' to be moved out of alignment with apertures 21 thereby closing the paste ducting passages. Such valve member movement may be facilitated or increased by suitable shaping or projection means on the casings of the components or by the actual disposition of the main hinge and the pivoting thereof.

In the arrangement of FIG. 5, as amplified by FIGS. 5*a*, and 5*b* and FIG. 6, the supply of paste through the hinge or pivot region between the container 10 and brush member 11 is achieved via a double swivel or cylinder joint 27 having double pivot portions 27' and 27'' respectively located by axial sliding and snap-fit in corresponding recess 28 in brush member 11 and in recess 29 in container 10. The recesses 28 and 29 each have a cut-out portion 30 to permit additional relative movement of the components during the pivoting to achieve the desired folded position and opened position. The joint member 27 has a central passage 31 for flow of paste urged by suitable means (not shown although similar to the previous embodiments) and in the open position of the device such passage 31 aligns with ducting means 32 and 33 in the container 10 and brush member 11 respectively. When the device is folded into the inoperative position, the bristles 13 located in recess 24 in the end member of container 10 and the aperture 26 in the bristles 13 is closed by a spike or like pointed closure member 25 in the bottom of recess 24. In such position the joint member 27 assumes a substantially vertical transverse position as shown in broken line so that the apertures 31 are no longer aligned with apertures 32 and 33 and thus the ends of the paste passage portions of the device are closed.

FIG. 6 is an enlarged fragmentary section showing the pivot connection in the operative position and showing a groove 10' and projection 11' in the container 10 and brush member 11 which are so shaped and dimensioned as to provide a snap-fit arrangement so as to hold the brush in the operative position during use and then permit disengagement and subsequent pivoting to the inoperative position.

In FIG. 7 there is illustrated a paste container 70 with pressurizing means and dispensing means for the paste as described in detail with respect to FIGS. 14, 15 and FIG. 16 with respect to the paste duct closure means. The container 70 has an elongate passage 36, extending along a side thereof and in which a similarly or correspondingly cross sectioned stem of a brush member 37 is retractably slidable into a collapsed position (FIG. 7*a*) from an extended position of use (FIG. 7). This arrangement permits generally linear displacement of the brush member 37 and bristles 13 from the operative position to the inoperative position. Paste is dispensed to the brush portion 13 through a duct 38 located adjacent the position of the bristles 13 when the brush member 37 is in the inoperative position, FIG. 7*a*. Paste duct closure means are provided comprising a spring biassed member 82, 83 operating as described hereinafter. A closure flap is hingedly located at the end of the container to close the end thereof when the brush member is moved into the inoperative position. Suitable detent and snap-fit arrangements are provided in the stem 37 and surrounding casing to hold the brush member in the operative position. Other telescopic arrangements are also considered within the scope of the present invention.

The embodiment of the toothbrush illustrated in FIGS. 8 and 9 comprises a paste container 42 for containing or receiving toothpaste and also acting as the handle for the toothbrush. Within the container 42 there is located a rotary threaded spindle or screw member 43 rotatably mounted at both end regions and rotatable by means of an end knob-like member 44 so that a pressure member or piston 45 is displaceable within the hollow space provided in the container 42 so as to thereby enable paste to be displaced therefrom via passage 46. The end member 44 also includes a recess 47 in which the bristles 13 of the toothbrush are locatable in the inoperative position of the toothbrush and a closure pin 48 extends from the base thereof for co-operation with the toothpaste outlet duct as will be described hereinafter.

A pivot connection 49 is provided between the container 42 and brush member 50 bearing bristles 13. The member 50 has a paste duct 51 extending therethrough and opening into the region of the bristles 13 by way of an aperture 51'. The pivotal hinge connection 49 between the container 42 and the bristle support member 50 is such as to permit paste to be displaced along the duct 46 and 51 to the bristles 13 in the operative position but to permit folding of the brush member 50 against or along the container 42 whilst at the same time closing the toothpaste ducts. The pivot comprises as extension on the container 42 comprising a cylindrical member or portion 52 supported in cantilever manner on an end face (in the remote side in the drawing (not shown)) by a part of container 42 with said cylindrical portion 52 being spaced from an arcuate part circle portion 53 of the container 42. A passage 54 is provided extending through the portion 52 and is off-centre relative thereto but aligned with passage 46. The end of the brush member 50 has an annular ring portion 55 provided thereon pivotally and securely locatable on portion 52 with apertures 55' and 55'' formed therein to be alignable in the operative position with passage 54 and passage 46.

In the assembled condition the ring 55 engages around cylindrical member 52 and is held thereon by suitable press fit means (not shown) and the brush member 50 is pivotable relative to the container 42. In the operative position with the bristle support pivoted away from the container 42, the paste ducts are all aligned so that paste may be urged through the ducts by displacement of member 45 to the bristles 13. The brush is retained in this position by press fit groove and socket means as shown. In the folded condition of the toothbrush, the bristle support member 50 lies along the container or handle portion 42 and the bristles 13 are located within the recess 47 with the pin 48 extending into the aperture 51' thereby closing such paste duct. The apertures 55' and 55'' in the inoperative condition are no longer aligned with the paste ducts 46 and 54 which said latter ducts are closed by the continuous solid surface of the ring portion 55. Any similar pivot interconnection, e.g. rounded or ball and socket-like means (possibly with the component parts being reversed in their location on the members) may be provided and appropriate sealing effected.

The embodiment illustrated in FIGS. 10 to 13 comprises a handle and paste container member 56 and a brush member or bristle support member 57 having a paste duct 58 extending therethrough and leading at the free end to an opening in bristles 13. The bristle support member 57 is pivotally connected to handle 56.

The handle 56 has a knob member 59 at one end for rotating a screw member 60 within the handle 56 so as to thereby displace a piston or pressure member 61 within the hollow container or handle 56 to cause paste located therein to be discharged through the paste ducts of the toothbrush and onto the bristles 13. Paste is discharged from the handle 56, through a duct leading through the pivot connection and through duct 58 to the bristles 13. The rotary knob member 59 defines a large recess in which the bristle members 13 may be located in the inoperative position of the device. Suitable closure means such as a pin 62 may be provided for the paste aperture in the bristles 13. The pivoting from the operative to inoperative position may be effected simply from the position of FIG. 10 in which case a side of knob 59 would have a gap (not shown) for the passage of the bristles 13 which may have a gap therein for rreceiving the closure means 62. However, in the preferred arrangement as shown the pivot connection between the handle 56 and bristle support member 57 has a displaceable characteristic in that the bristle support member 57 and handle 56 may be separated somewhat relative to each other so that the bristle support member 57 may be moved from the operative position laterally away from the handle 56 and then pivoted to the folded, inoperative position whereupon the two components are then pushed together so that the bristles 13 move into the recess 59' in the knob member 59 whereby pin member 62 located in the recess 59' thus engages with the aperture 26 in the bristles 13 to close the paste duct therein. FIG. 13 is a fragmentary detail of the pivotal connection wherein the members are shown separate and wherein an end wall 63 of the paste container portion 56 has an aperture 64 therein for the outlet of paste therefrom when displaced by the pressure means 61. The bristle support member 57 has a pivot axle 65 with a duct 65' extending axially therealong and also at right angles thereto. Axle 65 pivots in a passage in the handle 56 and duct 65' communicates with the duct 58 leading to the bristles 13. An aperture 65'' is provided in the wall of the axle 65 such that when in the operative position the aperture 64 and 65'' are aligned to permit paste to be discharged through the ducts to the bristles 13. An enlargement 65''' is provided at the end of the axle 65 co-operating with a groove 63' in the handle member such that the two handle and brush members may be displaced transversely relative to their longitudinal axis and relative to each other to permit the desired folding of the bristle support member alongside the handle member 56 and then the moving together of the two members to locate the pin 62 in the aperture 26 of the bristles 13.

The axial member 65 has two longitudinal ribs 66 diametrically opposite and located in a plane at right angles to the longitudinal axis of the brush member 57. The ribs 66 co-operate with co-operating grooves 67 formed in the transverse passage in the handle member 56 so as to act to retain such ribs in the grooves. This arrangement permits the toothbrush to be retained in its operative position until the ribs are displaced out of the grooves and displaced through approximately 180° whereupon the ribs 66 relocate in the grooves 67 and the members are then held securely in the inoperative position.

In the embodiment of FIGS. 14 and 15 a non-pivoting toothbrush arrangement is shown wherein there is provided an axially displaceable knob or rotary member 68 biassed by spring means 69 outwardly of toothpaste container 70 having bristle support 71 extending therefrom and carrying bristles 13. A piston or pressure member 72 of generally rectangular form with inclinded faces 78 is carried by a rod 79 on which there are located a plurality of conical members 80 arranged to point in the same direction and resilient so as to be displaceable through a correspondingly shaped conical aperture 77' in member 77. The portions 80 are shaped so as to be capable of being drawn through aperture 77' whereupon they are reduced or compressed in diameter somewhat and on passing therethrough, from right to left in FIGS. 14 and 15, they then expand and act against the flat surface of member 77 acting to be pushed thereagainst and not be displaceable through the aperture 77'. On opposite walls of rectangular paste container 70, there are located a plurality of parallel, step-like teeth 81 forming a ratchet-like arrangement co-operably engageable with the sloping surfaces 78 of member 77 such that when the member 77 is urged by portion 80 acting against the lefthand face thereof as shown in the drawings, member 77 may be displaced step-like along from groove to groove between the teeth 81—the resilience of the casing and teeth and the portions 80 permitting this action. This opposite ratchet-like arrangement enables the member 77 to be stepped along the teeth of ratchet 81 by depressing knob 68. The spring 69 causes conical portions 80 to be drawn stepwise through the member 77 whilst the non-sloping surfaces of the teeth 81 prevent movement of the member 77 towards knob 68. The next depressions or axial movements of the knob 68 into the container 70 causes a stepwise movement of the member 77 within the paste container 70 thereby causing stepwise urging of the paste through the paste duct 71' and to the bristles 13. Such step-like paste dispensing mechanism may be provided in the earlier arrangements in place of the threaded screw member as would be readily apparent to persons skilled in the art without undue major modification—various possible arrangements also exist for modifying the paste duct closure means.

A paste duct closure means is shown adjacent the aperture leading to the bristles 13 and comprises a displaceable cylinder or like member 82 spring biassed by spring 83 into a closed position sealing off the aperture 84 leading to the bristles 13. Upon movement of the member 77 by action on knob 68 the paste is urged under pressure through duct 71 and such pressure displaces the closure member 82 against the action of the spring thereby opening the paste duct to the aperture 84 and the bristles 13 and permitting paste to be urged to the bristles. Upon reduction of paste pressure, the spring 83 causes the member 82 to close the paste duct. This arrangement might be provided for the earlier disclosed embodiments without undue modification and such is shown in greater detail in FIG. 16.

In FIG. 17 an arrangement is provided which is particularly suitable for use with a rotary, axially displaceable threaded member as an extension thereof so that rotation of the extension 85 causes circular closure member 86 to move through 180° thereby opening the paste duct 81 for a short while permitting paste to be urged to the bristles 13.

Figure 18:
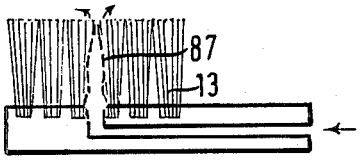

FIG. 18 shows an alternative arrangement of paste duct closure means wherein a polythene or other plastics material flexible finger 87 extends from the aperture in the paste duct and is closed by the pressure of the surrounding bristles 13 although does open under paste pressure to permit paste to be discharged into a upper region at the top of the finger 87 in the upper region of the bristles 13.

Figure 19:
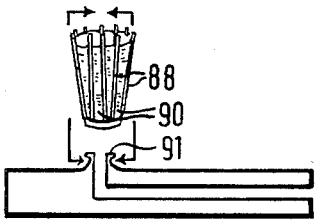
Figure 19A:
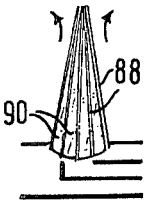

FIG. 19 shows a still further alternative arrangement of the paste duct closure means comprising a number of ribs 88 joined together with a flexible film or the like material 90 and may be clipped onto the paste duct outlet aperture 91 such that the member by virtue of the resilient film 90 closes together to form a stack-like arrangement as shown in FIG. 21*a* through which paste may be urged upon action on the paste displacing means but which close together to seal off the aperture when the paste pressure drops.

In an alternative arrangement (not shown) bristles 13 may be arranged in sloping manner or groups thereof in sloping manner about the paste duct aperture so as to form a conical or surrounding abutting arrangement through which paste may be urged under pressure but which act to close the paste duct when the pressure is relieved.

Figure 20:
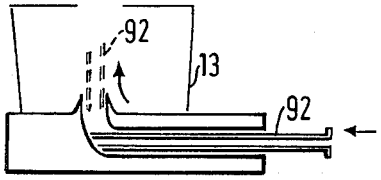

FIG. 20 shows an alternative arrangement of paste duct closure means whereby a flexible tube member 92 is located within the paste duct and forms part thereof and upon relative displacement of the bristle support member relative to said tube 92 the tube 92 is displaceable upwardly into the bristles 13 as shown in broken line to permit paste to be displaced therefrom via previously described paste dispensing means (not shown). The bristle head may be then retracted or displaced by spring means relative to the tube 92 to assume the position as shown in FIG. 20 whereby the end of the paste duct formed by the end of the flexible tube is closed.

Figure 21:
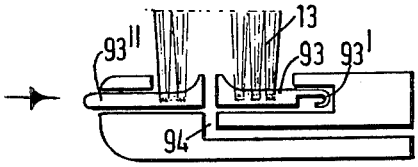

An alternative arrangement is shown in FIG. 21 whereby the bristles 13 are supported on a displaceable member 93 spring biassed by a resilient portion 93' into the open position as shown but which bristle support 93 is used with a folding arrangement whereby the edge 93" strikes against a surface causing displacement in the direction of the arrow and closure of the paste duct means 94.

Figure 22:
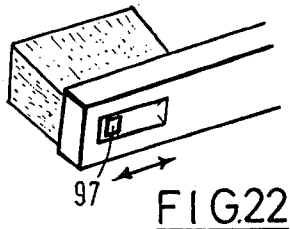

FIG. 22 shows a schematic perspective view and section of an alternative arrangement of the paste duct closure means whereby a closing piston 95 is displaceable in the duct 96 leading to the bristles 13 from open to closed position by virtue of manual action on the trigger 97 as shown.

Figure 24:
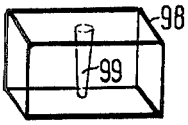
Figure 23:
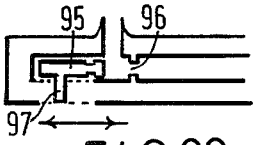

FIG. 24 shows a cover cap 98 with paste duct closure member 99 which may be provided so as to locate over the bristles 13 and thereby provide hygenic cover whilst at the same time providing a bristle paste duct closure member pin.

FIG. 25 shows a simple arrangement with a rectangular or other non-circular section paste container 100 carrying a rotary threaded spindle 101 with paste pressure or displacing member 102 and a knob 103 which upon rotation causes the member 102 to move along threaded spindle 101 and urge paste towards paste duct closure means 82, 83 which is similar to that described in FIGS. 15 and 16.

In the arrangement of FIG. 26 an extension 101' to the threaded member 101 is provided carrying a closure cylinder 82 which is spring biassed to a closed position by a spring 83. The rotary knob 103 is provided on the other end of the threaded spindle 101 to effect rotary movement of the spindle. A plate 104 secured in the container 100 has a spring biassing means 105 acting thereagainst and against a box-like member 106 also carried by the threaded member 101 such that on axial displacement of the threaded member 101 the spring 105 is compressed as is the spring biassing means 83 of paste duct closure member 82 so as to permit the duct 107 leading to the bristles 13 to be opened and paste to be discharged. On relaxation of the axial pressure on the knob 103 the springs then act to return the threaded member and components carried thereby to thereby close the paste duct 107 by means of closure member 82.

FIG. 27 is a schematic cross-sectional illustration of a further embodiment with paste displacing means and paste duct closure means similar to previous embodiments. FIG. 28 is an exploded fragmentary schematic perspective of the hinge interconnection between the paste container and brush member and this comprises a hinge member 108 secured to the container 10 and brush member and having a cut out portion 108' permit folding into the inoperative position shown in broken line. A flexible tubular member 109 is located in sealing engagement with paste duct 110 in the container 10 and duct 33 in member 11. The tubular member will be of such nature as to permit required folding and may even be such as to collapse and close the paste duct in the folded position if desired.

The provision of a toothbrush with toothpaste within the handle and with a brush member pivotable or telescopic or extendable and retractable relative thereto is of considerable advantage to persons desiring a compact and simple teeth cleaning arrangement which is readily portable.

In the previously described arrangements various components or mechanisms may be interchanged as desired. Further various modifications and changes may be made without departing from the scope of the invention. For instance, the brush member may be hingedly mounted on a side of the paste container and have a duct communicating with the paste container interior in the operative position. The rotary spindle with two oppositely threaded portions may be provided and two paste pressure members also provided acting in opposite directions and moving together to displace the paste.

The device is preferably made of plastics material and mouldings, snap-fit connections etc., will be apparent to persons skilled in the art.

It will be understood that the terms "toothpaste" and "paste" are used herein in their broadest sense to designate any suitable dentifrice in any desired form.

The paste may be contained in a flexible plastic bag or tube open at one end and utilizable as a refill—dispensing to bristles being effected by collapsing the bag by suitable means. A compartment may be provided (such as shown in FIGS. 1 or 27) preferably in the rotary knob member when provided for receiving a bobbin of dental floss and/or a toothpick device, preferably formed on a flat sheet of shaped flexible plastics material (not shown).

It will be appreciated that many modifications or changes can be effected in putting the invention into practice.

I claim:

1. A combined toothpaste dispenser and toothbrush device comprising an elongate container for receiving or containing toothpaste and forming a handle member, a toothbrush member pivotally connected or connectable to said container and supporting bristles, ducting means leading or capable of leading from the container to the bristles of said brush member, and means for enabling paste to be urged through said ducting means to said bristles, said toothbrush member being adapted to be pivotally displaced relative to said elongate container so that in an inoperative position the brush member is juxtaposed or lies along or adjacent said container with the bristles of the brush member located within a space or recess within the handle member or a displaceable paste dispensing member adjacent thereto, while in the operative position the brush member extends from the end of said container and away therefrom to permit teeth-cleaning operations to be effected, and wherein the space or recess has a pin or like closure means situated such that when the brush member is pivoted into the inoperative position the pin or like closure means engages an aperture of the ducting means opening at the bristles to close the aperture.

2. A combined toothpaste dispenser and toothbrush device comprising: a container for containing toothpaste and forming an elongate handle member; a toothbrush member supporting bristles of the brush having an elongate stem and being pivotably connected to one end of the handle member by pivot connection means so as to be pivotably displaceable between an operative position, wherein the toothbrush member extends outwardly from the end of the handle member, and an inoperative position wherein the toothbrush member lies adjacent the handle member; ducting means for establishing a passage when the toothbrush member is in said operative position, said ducting means having regions leading from the container extending through said pivot interconnection means and regions adjacent thereto, and through said toothbrush member to the bristles of said brush member so that paste may be dispensed from the container through said ducting means onto the bristles when said toothbrush member is in said operative position; means for urging toothpaste through said ducting means from the container to said bristles; duct closure means for selectively closing the passage when established by said ducting means; and wherein in the inoperative position the bristles of the toothbrush member are located within a space or recess at the end of the handle member remote from the one end at which the toothbrush member is pivotally connected to the handle member, with said space or recess being provided within the handle member or a displaceable paste dispensing member adjacent thereto; and wherein the duct closure means and the ducting means leading to the bristles are arranged such that the ducting means, including the region thereof extending through said pivot interconnection means, regions adjacent thereto, and the region opening to the bristles, are automatically closed to the atmosphere upon the toothbrush member being displaced to the inoperative position.

3. A device as claimed in claim 2, wherein the pivot connection means connecting the brush and handle members comprises a double swivel having two pivot portions connected to each other and an aperture extending therethrough constituting a portion of said ducting means, said pivot portions being locatable by a snap-fit or the like in corresponding recesses provided in the brush member and handle member, and wherein said recesses are suitably shaped in the respective members to permit movement of the members between the inoperative position adjacent each other and the operative position.

4. A device as claimed in claim 2, wherein the pivot interconnection means include a rounded portion of the handle member having a duct extending therethrough, the duct being aligned with an aperture in the handle member through which paste may be urged, and wherein the pivot interconnection means further include a portion of the brush member having a correspondingly ring shape co-operable with said rounded handle member portion, the ring-shaped brush member portion having apertures therein, one of the apertures communicating with the paste duct leading to the bristles such that said ring-shaped member is locatable and pivotable on said rounded portion so that in the operative position the apertures are aligned with the duct to permit discharge of paste while in the inoperative position the apertures in the ring-shaped portion are not aligned with the duct whereby the ring portion acts to close the duct in the handle member and closes the aperture in itself in cooperation with the rounded member.

5. A device as claimed in claim 2, in which the pivot interconnection means comprises a hollow axle having a paste passage therein and the bristles are displaceable from the operative position into the inoperative position in a recess of a rotary knob for operating the paste urging means.

6. A device as claimed in claim 2 wherein the ducting means include a flexible pipe located in aperture means formed in each of said paste container and brush members so as to communicate the interior of the paste container with a paste duct formed within the brush member and to permit the toothbrush member to be moved between the operative and the inoperative position.

7. A device as claimed in claim 2 wherein the toothpaste urging means comprise a screw member extending within the paste container of the handle and a pressure member mounted on the screw member, the latter being rotatable by knob means to displace the pressure member within the container to urge paste through said ducting means.

8. A device as claimed in claim 2, wherein said handle member includes a rotary knob portion in which said recess is located, said knob portion constituting a part of said means for urging the paste through the ducting means, said knob portion being provided in a region of the handle member remote from the pivot interconnection means.

9. A device as claimed in claim 2 wherein detent means are provided on the container and brush members for retaining the toothbrush member in the operative position and permitting displacement thereof into the inoperative position.

10. A device as claimed in claim 9, in which the detent means comprises a clip or snapfit or like detent means provided between the handle and the brush members to hold the brush member in the operative position.

* * * * *